US005855528A

United States Patent [19]

Aiello et al.

[11] Patent Number: 5,855,528

[45] Date of Patent: Jan. 5, 1999

[54] HOCKEY PUCK

[76] Inventors: Jeffrey A. Aiello, 718 Bradley St., Matteson, Ill. 60443; Keith James O'Neal, 2129 W. Richton Rd., Steger, Ill. 60475

[21] Appl. No.: 679,103

[22] Filed: Jul. 12, 1996

[51] Int. Cl.[6] ..... A63B 71/00

[52] U.S. Cl. ..... 473/588

[58] Field of Search ..... 273/128 R, 128 A, 273/128 CS; 473/588, 589, 587

[56] References Cited

U.S. PATENT DOCUMENTS

| | | | |
|---|---|---|---|
| 2,727,744 | 12/1955 | Watson . | |
| 3,726,526 | 4/1973 | Padovich . | |
| 3,784,204 | 1/1974 | Felber . | |
| 3,997,164 | 12/1976 | White, Sr. . | |
| 4,111,419 | 9/1978 | Pellegrino . | |
| 4,801,144 | 1/1989 | De Masi, Jr. et al. . | |
| 5,149,096 | 9/1992 | Keating et al. . | |
| 5,184,820 | 2/1993 | Keating et al. | 273/128 R |
| 5,275,410 | 1/1994 | Bellehumeur et al. | 273/128 R |
| 5,284,343 | 2/1994 | Bigornia et al. | 273/128 R |
| 5,346,214 | 9/1994 | Bruhm | 273/128 R |
| 5,366,219 | 11/1994 | Salcer et al. | 273/128 R |
| 5,465,966 | 11/1995 | La Savio | 273/128 R |
| 5,482,274 | 1/1996 | Bellenhumeur | 273/128 R |
| 5,518,237 | 5/1996 | Bellehumeur | 273/128 R |

*Primary Examiner*—Raleigh W. Chiu
*Attorney, Agent, or Firm*—Hill & Simpson

[57] ABSTRACT

A hockey puck for street hockey or roller hockey has a cylindrical body with a hollow interior having liquid in the interior. Another embodiment provides a baffle in the interior of the hollow body to control the flow of the liquid within the cylindrical body. A further embodiment provides low friction slider members on the end faces of the puck. The slider members are arcuate shaped and are arranged around the periphery of the top and bottom surfaces of the puck. In a further embodiment, the slider members wrap around the edges of the puck onto the cylindrical side. The slider members can be used with or without the liquid containing interior space. Another embodiment provides a shock absorbing center portion in the form of a central core with flexible spokes extending between the core and an outer ring.

40 Claims, 3 Drawing Sheets

10
12
14
16
18
20
22
24
26
40
42
42a
42b
44
46
48
50
52
54
56
60
62
64
66
68

FIG. 6
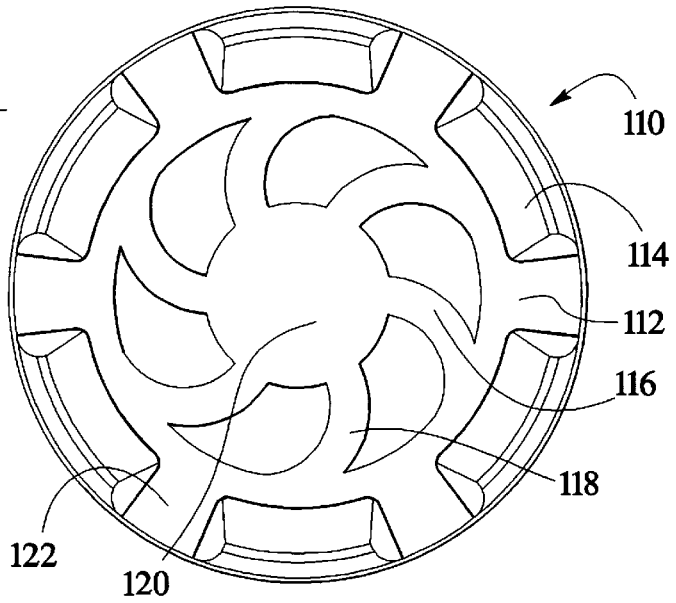
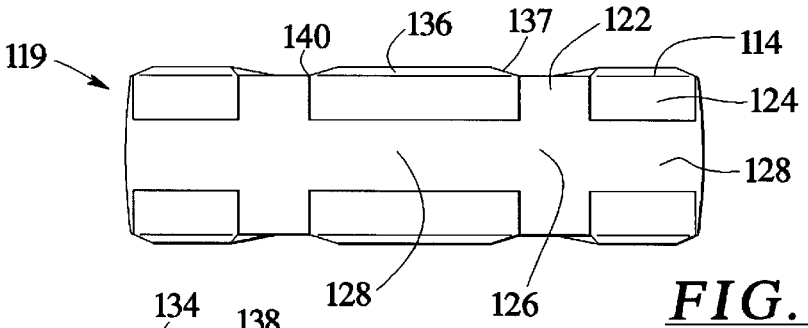
FIG. 7
FIG. 8
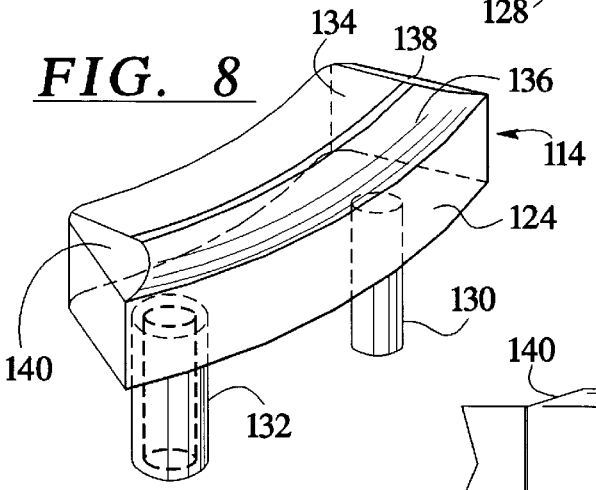
FIG. 9
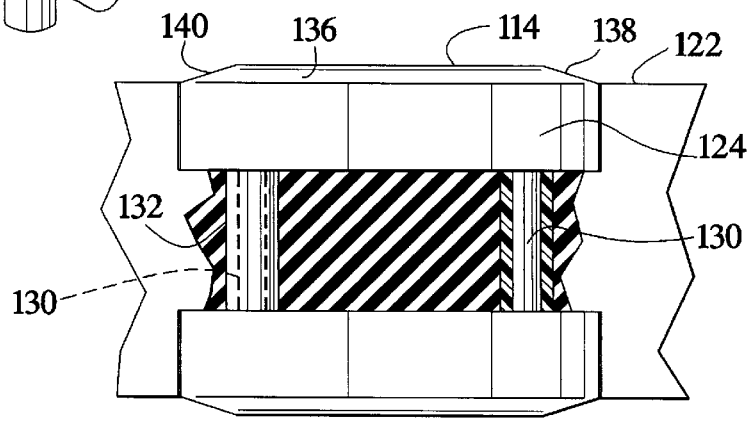

HOCKEY PUCK

BACKGROUND OF THE INVENTION

1. Field of the Invention

The present invention relates generally to a hockey puck, and in particular to a puck for playing hockey on, for example, a non-ice surface.

2. Description of the Related Art

Ice hockey is played on ice in an ice rink or on the frozen surface of a pond, lake or river using a puck. The puck is flat cylinder of hard rubber, and due to the slipperiness of the ice it slides easily across the surface of the ice. The puck tends to stay flat, resting on one of its flat surfaces, as it is moved across the ice by the players using hockey sticks, again due to the slipperiness of the ice.

An increasingly popular sport is floor hockey or street hockey, which is played much the same as ice hockey except that is its played on a floor, street, parking lot, tennis court, or other dry surface. The players thus do not wear ice skates during play but may wear athletic shoes, roller skates or in-line skates, and the play is not limited to cold weather when played outdoors or on an expensive ice rink when played indoors.

Floor hockey or street hockey uses either a puck or a ball as the puck in a way comparable to ice hockey. A variety of pucks have been proposed to simulate the playing characteristics of the hard rubber ice hockey puck on ice. For instance, soft rubber pucks are known. These are either solid or hollow and are best suited for children and less experienced players, since the soft rubber tends to grip the playing surface rather than slide across it. Hard rubber pucks are also known. A type of hard rubber puck on the market has round pegs projecting in an arrangement on the flat surfaces to enhance sliding of the puck on the playing surface.

All of the known pucks for non-ice surface play have disadvantages in simulating the action of a puck on ice. The pucks do not slide well, which causes them to move slower and for less distance. This is particularly true when the puck is used on a type of playing surface referred to as sport court, which has a 15 to 20 percent rubber content. The pucks have a greater tendency to bounce and to tip up on edge and roll across the floor out of control than when played on ice. This is very disruptive for the players since the rolling puck travels much farther and faster than a sliding puck so that it may have to be chased. Further, the rolling puck often veers off in different directions, usually on a curved path, as it rolls instead of sliding along a generally straight line. Accurate passing and shooting of the puck is thereby difficult to accomplish.

SUMMARY OF THE INVENTION

The present invention provides a puck for play on a non-ice surface which slides easily across the surface in a controlled manner.

The invention also provides a puck that resists the tendency to roll on its edge during play, instead staying flat during movement.

The present puck also has a reduced tendency to bounce during movement.

The present puck overcomes the disadvantages of the known pucks and provides a floor or street puck that behaves like a puck on ice.

These advantages are realized by a puck, that in one embodiment, has a hollow center inside a rubber body, the hollow center being partially filled with water or other liquid to control bouncing and provide stable movement. A baffle may be provided in the puck to control liquid movement in the puck. The liquid splashed around inside the puck to absorb shock during impact and movement and, further, acts to shift the center of gravity of the puck toward on side so that should the puck be flipped up on edge, such as when struck by a hockey stick or when it strikes a wall or other surface, the puck moves back to a position flat on the playing surface.

Another embodiment of the puck which is seen as an improvement over the foregoing provides sliding members of slippery material mounted about the perimeter of the puck on both flat sides. The sliding members are of a material having a low coefficient of friction to enhance the sliding characteristics of the puck. Ideally, a ring of sliding material is provided on each flat face of the puck, but the sliding material is brittle and so a discontinuous ring is formed instead. This embodiment may also have a center portion with means for absorbing shock as the puck strikes a surface such as a side wall of the playing area or is struck by a surface such as a hockey stick. The portion of the puck surrounding the center portion forms an outer ring in which the sliding members are mounted. The means for absorbing shock at the center portion of one embodiment is a central core with spokes extending from the central core to the outer ring. The spokes are curved and are of flexible material, in a preferred embodiment.

Another embodiment provides that the means for absorbing shock is a hollow interior at the center portion that is partially filled with liquid as in the first embodiment. This embodiment includes the outer ring and slider members as well. As an improvement, the embodiment having the liquid in the center may also have a baffle in the liquid chamber to control liquid flow.

The slippery material provided at the perimeter of the puck is preferably in the form of arc-shaped members attached near the edge of the plastic body of the puck to form the discontinuous ring. A plurality of such arc shaped members is arranged around the edges of the puck. The slippery material used in the present puck is generally brittle and can crack when the puck is struck hard if the material is formed into a solid ring, so the present embodiment provides the arc-shaped members arranged somewhat spaced from one another to form a discontinuous ring so that the flexibility of the plastic puck body lends resiliency to the discontinuous ring of slippery material. If an appropriate material is used which withstands impacts, the sliders are to be formed into rings. Other means for providing flexibility to the slippery material are also contemplated for incorporation into the present invention.

The arc-shaped slider members are attached to the plastic puck body by pegs that are formed integrally with the arc-shaped members. The pegs extend into holes in the puck body and are fastened there by grips or other means. One means of fastening the slider members in the puck body is to provide a friction fit between posts of sliders extending into the puck from opposite sides. The slippery arc-shaped members may be formed permanently in the puck, but since the slippery material experiences a greater amount of wear than the puck body, it is preferred that the arc-shaped slippery members be replaceable by the user. Accordingly, it is contemplated to provide the present puck with a supply of replacement sliding members which the user can fasten into place when necessitated by wear or lose.

A further embodiment of the invention provides a puck with the slider members shaped with raised edges at the edge of the puck so that a concave surface is formed on the flat sides of the puck. The slider members also extend to and possibly slightly beyond the outer edge of the puck to provide the advantages of the slippery surface on the edges of the puck. The slider members may also extend on the side surfaces of the puck as well. The preferred slide members are sloped or beveled on edges toward the adjacent slide members and toward the center of the puck to eliminate raised edges that are caught by the hockey stick during play or that catch on rough playing surfaces. Importantly, the slider members permit the puck to ride over the playing surface during play. The slide members are set into the surface of the puck body, and possibly, the puck body is formed to dove-tail the slide members in place.

BRIEF DESCRIPTION OF THE DRAWINGS

FIG. 6 is a plan view of yet another embodiment of the puck having flexible spokes in a center portion;

FIG. 7, is a side elevational view of the puck of FIG. 6;

FIG. 8 is a perspective view of a slider member for the puck of FIG. 6; and FIG. 9 is a side cross-sectional view of a pair of the sliders of FIG. 8 in the puck of FIG. 6.

DETAILED DESCRIPTION OF THE PREFERRED EMBODIMENTS

Figures 1, 2, 3:
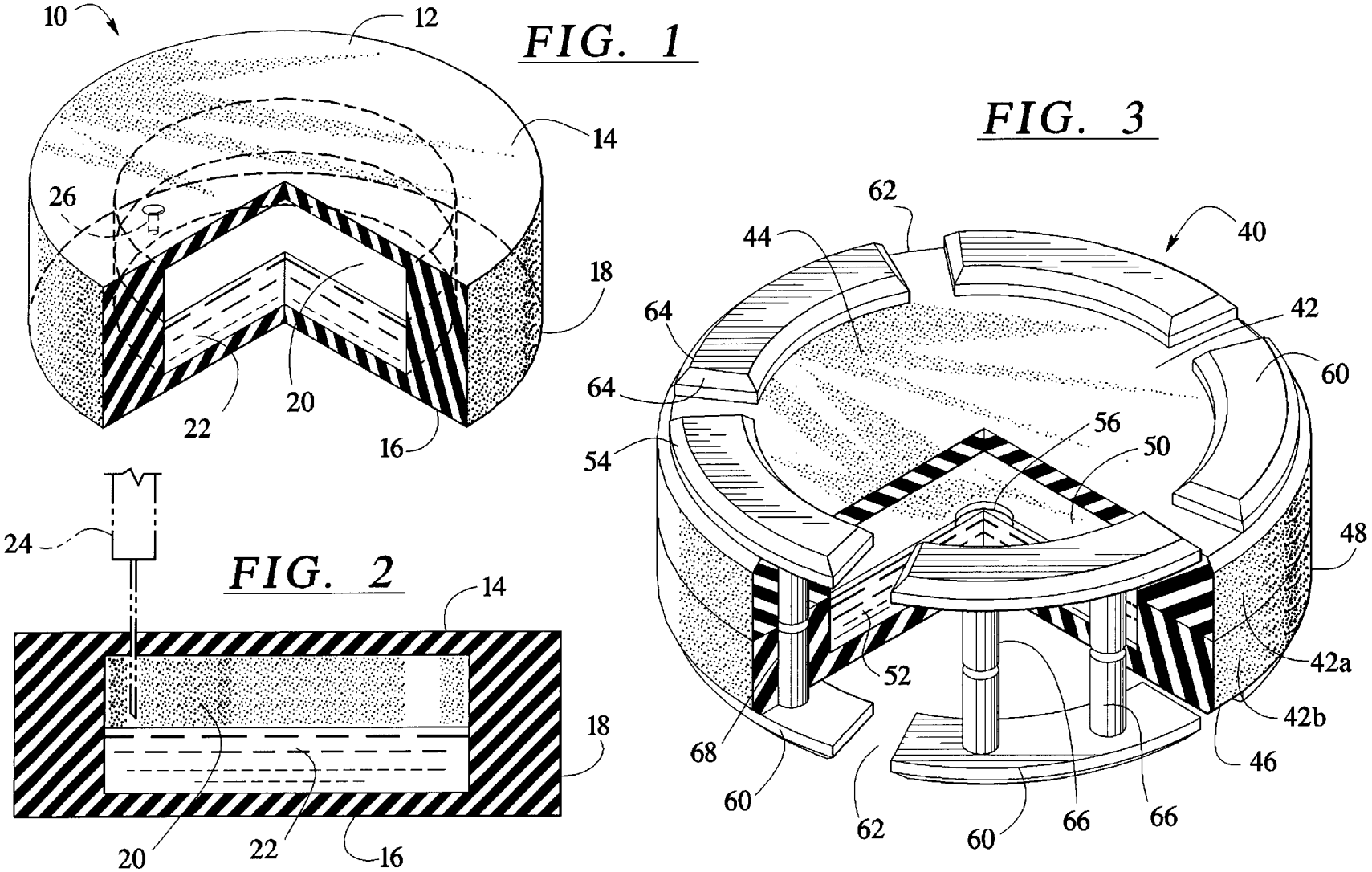
FIG. 1 is a perspective view of a first embodiment of a hockey puck according to the principles of the present invention, partially cut away to reveal the hollow interior partially filled with liquid.
FIG. 2 is a cross section of the puck of FIG. 1 showing an injection needle for injecting the liquid into the puck.
FIG. 3 is a perspective view, partially cut away, of a second embodiment of the puck of the present invention, including sliding members on the flat surfaces of the puck.

Referring first to FIG. 1, the present puck 10 is formed by a puck body 12 in the shape of a short cylinder with generally flat top and bottom surfaces 14 and 16 and a cylindrical outer surface 18. The puck 10 is generally the same size and shape as a standard ice hockey puck, although some variation in size is contemplated. The diameter of the puck 10 is in the range of 2 to 5 inches (about 5 to 12 cm), and is preferably 2.75 to 3.75 inches (7 to 9.5 cm) in diameter. One puck is 3 inches (7.5 cm) in diameter while another is 3.2 inches (about 8.1 cm) in diameter. The axial height of the puck may be in a range of 0.75 to 1.25 inches (1.9 to 3.2 cm), and one puck is 1.95 inches (about 2.4 cm) in height. The puck 10 may weigh approximately 4.5 oz. (126 g.) while another weighs 3.7 oz., although other weights are possible. For example, weights from 1.75 up to 6 oz. are contemplated. The puck 10 of FIG. 1 is of a soft rubber or plastic type material or some other relatively flexible material. In one embodiment, the puck 10 of FIG. 1 weighs about 1.9 oz. (54 grams). A range of 50 to 60 grams or broader is contemplated for this puck.

The puck 10 of FIG. 1 is quite flexible, which makes it safe for use by children and less experienced player and all who may be concerned with injury from being struck with the puck. However, it does not slide as well as the embodiments described hereinafter.

The puck 10 is hollow with an interior space 20 being defined therewithin. A portion of the interior space 20 is filled with a liquid 22. For example, the liquid 22 fills about one half of the interior space 20 in the illustrated embodiment. In one embodiment, the puck has a capacity of 60 ml in the hollow interior. The effects of the liquid 22 are first noticeable at 5 ml, and about 20 to 30 ml of liquid provide a pronounced dampening effect on the bounce action of the puck while still maintaining the straight line passing speed of the puck. The range of fill according to the present invention can be from 0 to 100 percent, however. The liquid 22 is preferably water, possibly mixed with or replaced by other substances such as oil or glycerol. The other substances may be used to change the viscosity of the liquid 22 or to lower freezing temperature of the liquid so that the puck 10 can be used outdoors in cold weather without freezing of the liquid.

The liquid 22 splashes around in the hollow interior to absorb impacts to stabilize the puck during movement, and it also shifts the center of gravity of the puck 10 lower so that the center of gravity is below the center of the puck. This lowering of the center of gravity helps to stabilize the puck 10 during play so that the puck 10 tends to stay flat on the playing surface during movement of the puck. When the puck 10 is struck, such as by a hockey stick, or when the puck 10 strikes a surface, such as a boundary wall of the playing surface, the liquid containing puck 10 has less tendency to bounce or to tip up on the cylindrical surface 18 and roll away due to the liquid splashing around in the hollow interior and possibly due to the lower center of gravity. The liquid 22 moves within the puck 10 to change the character of movement of the puck 10 so that if it is tipped up on edge 18, the puck 10 falls back to one of the flat surfaces 14 and 16 instead of rolling away. The liquid 16 in the puck 10 also acts to absorb shock as the puck is struck, for example, with a hockey stick, or when the puck strikes a surface, such as a wall or hockey stick. The shock absorbing properties of the puck 10 reduces or dampens the bounce of the puck to enable the player to have better control of the puck. In other words, the puck has less tendency to bounce away from a hockey stick during so-called stick handling of the puck, or during passing from one player to another. The reduction in bounce is also noticeable when the puck is moved across the playing surface and passes over rough places, gravel, sticks, or the like.

The present puck 10 is simple and inexpensive to make. For example, the body 12 is molded with the hollow interior 20, and then the liquid 22 is injected into the interior 20, as shown in FIG. 2. In particular, a liquid injecting needle 24 pierces the body 12 and the liquid 22 is thereby injected. The opening made by the injection needle is sealed by a plug 26 as shown in FIG. 1. Other means for providing the liquid 22 in the puck are also contemplated, including molding the puck with the liquid inside.

In one embodiment of the puck, the top and bottom walls 14 and 16 and the side walls 18 of the puck 10 are of equal thickness. However, an alternative is illustrated in FIG. 2, wherein the side walls 18 of a greater thickness than the top and bottom walls 14 and 16. This may have advantages, since the side walls 18 receive the greatest impact forces during use of the puck 10. The top and bottom wall thickness may be 1/16 to 1/4 inch (1.6 to 2.5 mm), and 3/32 inch (2.4 mm) is preferred. The outer wall thickness may be in a range of 1/16 to 1 inch (1.6 mm to 2.54 cm) and 1/2 inch (1.3 mm) is preferred.

An alternate embodiment of the present puck is shown in FIG. 3. The puck 40 is formed by a body 42 of a cylindrical shape having top and bottom surfaces 44 and 46 and a cylindrical side wall 48. The puck 40 of FIG. 3 is of a flexible material, such as a hard or soft plastic. The puck 40 is also provided with a hollow interior defining a space 50 into which is partially filled a liquid 52. The second embodiment of the puck 40 is formed from two parts 42*a* and 42*b* that are joined to one another at the edges to define the interior space 50. For example, the parts 42*a* and 42*b* may be joined by glue or by plastic welding using friction or heat. The liquid 52 is put inside the hollow puck 40 during assembly of the parts 42*a* and 42*b* so that no hole need be formed in the body 42.

An additional feature of the present embodiment is a baffle 54 which divides the interior space 50 approximately in half. The baffle 54 is generally parallel to the flat sides 44 and 46 of the puck body 40. The baffle 54 has a passage 56 through which the liquid 52 may flow. The passage 56 of the illustrated embodiment is in the center of the baffle 54. When the puck 40 is in the illustrate position with the flat surface 46 down, the liquid 52 flows through the passage 56 into the lower portion of the interior space. The center of gravity is shifted below the physical center of puck 40. If the puck 40 is tipped up onto the side 48, it has a tendency to fall back onto the flat surface 46 before the liquid 52 flows through the passage 56 to any great extent. If the puck 40 is flipped completely over onto the flat surface 44, the liquid 52 flows through the passage 56 and into the now lower portion of the interior space. The puck is now stabilized in the position resting on the flat surface 44.

The passage 56 is of a size relative to the viscosity of the liquid 52 to permit the liquid to flow through the passage 56 at a rate so that quick movement of the puck as it is struck does not shift the center of gravity greatly, but once the puck has reached a stable position the liquid can flow to the lower chamber if it is not already there.

An added feature of the second embodiment 40 is the presence of sliding members 60 on the top and bottom surfaces 44 and 46 of the puck 40. The sliding members 60 are of a slippery material such as Delrin, or a Delrin and teflon blend, and so provide a low friction surface for sliding movement across a playing surface. The slippery material is less flexible than the rubber material of the body 42 and is somewhat brittle, so the sliding members 60 are provided as separate arc-shaped pieces spaced by gaps 62 from one another. The gaps 62 enable the puck 40 to deform during high impact play without cracking or breakage of the relatively brittle sliding members 60. Although five such sliding members 60 are provided on each flat side of the illustrated puck 40, six sliding members are also contemplated. Any number of sliding members may be provided according to the present invention.

The sliding members 60 enable the puck 40 to move over the playing surface with reduced friction so that play is faster. The sliding members 60 have beveled edges 64 on the inside and outside curved edges and on the ends facing the neighboring sliding members. The beveled edges 64 help prevent the sliding members 60 from being caught by a hockey stick, for example, during play or from catching on rough playing surfaces. This prevents the sliding members from having a detrimental effect on play compared to a standard hockey puck on ice. The beveled edges also streamline the puck for movement through the air and on the surface.

The sliding members 60 extend about the periphery of the top and bottom surfaces 44 and 46 to as great an extent as possible with the gaps 62 being small. In one embodiment, the gaps 62 between the sliding members are about one eighth inch (3.1 mm) The smaller gaps 62 reduce the space into which a hockey stick can catch but more importantly reduce the chance that the playing surface will come into contact with the puck body between the sliding members. The sliding members are over a greater extent of the periphery of the puck than is occupied by the gaps, preferably by a considerable amount. The smaller the gaps 62 the less chance the puck body 12 will contact the playing surface between the sliding members at the gaps 62.

Similarly, the sliding members 60 are to be as close as possible to the peripheral edge of the top and bottom surfaces 44 and 46. The sliding members 60 thereby are in contact with the playing surface even when the puck is tipped up at a relatively steep angle, so that the cylindrical surface 48 does not contact the playing surface except when the puck is completely on the edge.

By keeping the sliding members 60 on the playing surface when the puck is tipped at an angle, the sliding members 60 permit the puck 40 to slide to a flat position. The sliding of the puck 40 back to a position with the surfaces 44 and 46 parallel to the floor or other playing surface results in play similar to play with a puck on ice. The sliding members 60 can therefore be used on a puck without the liquid filled interior of the illustrated embodiment. Alternately, the sliding members 60 may be used on a one piece, molded puck like that shown in FIGS. 1 and 2.

The sliding members 60 may be affixed to the puck body 42 in a variety of ways. In the illustrated embodiment, the sliding members 60 each have two posts 66 that extend into openings 68 in the puck body 42. The posts 66 may be fasted into the openings by glue, friction fit, ridges (not shown) on the posts, or other means. The sliding members 60 on the top surface 44 are opposite the sliding members 60 on the bottom surface 46 and the posts 66 fit into the same openings 68 from opposite sides. The posts 66 do not contact one another in the illustrate embodiment of FIG. 3, although the posts do contact and fasten to each other in other embodiments. For example, the posts are friction fit together in one embodiment. The sliding members 60 are preferably replaceable and are fastened in the puck body 42 so that they can be removed when worn and replaced with new sliding members 60. To accomplish this, the posts 66 may be shaped to snap into the openings 68.

The faster play enabled by the sliding members 60 enables play more nearly like hockey played on ice. The liquid filled interior or other shock absorbing means, if used, improves handling of the puck regardless of playing surface.

Figure 5:
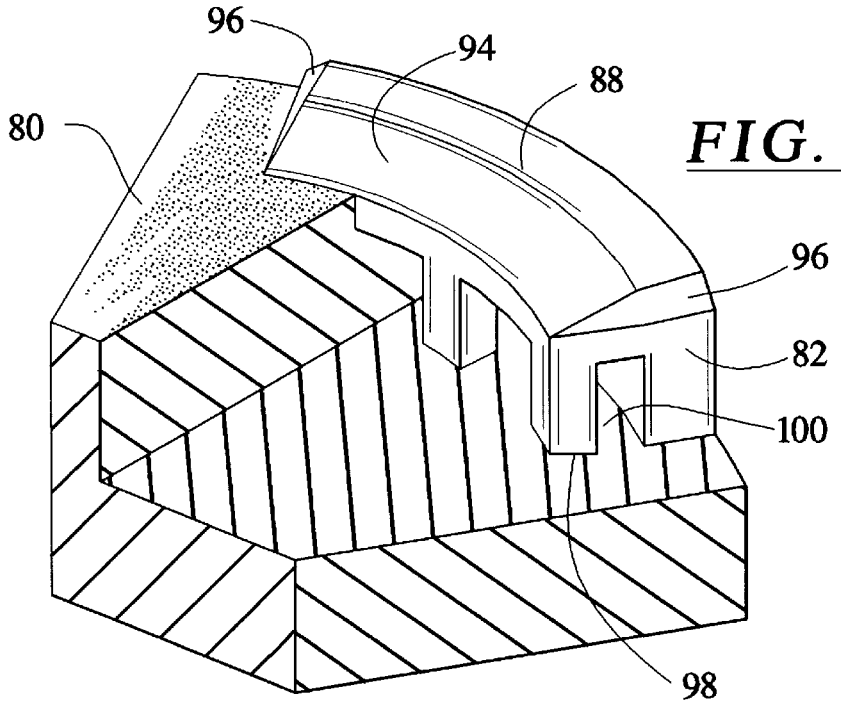
FIG. 5 is a partial perspective view of the embodiment of FIG. 4 showing one sliding member mounted in the puck.
Figure 4:
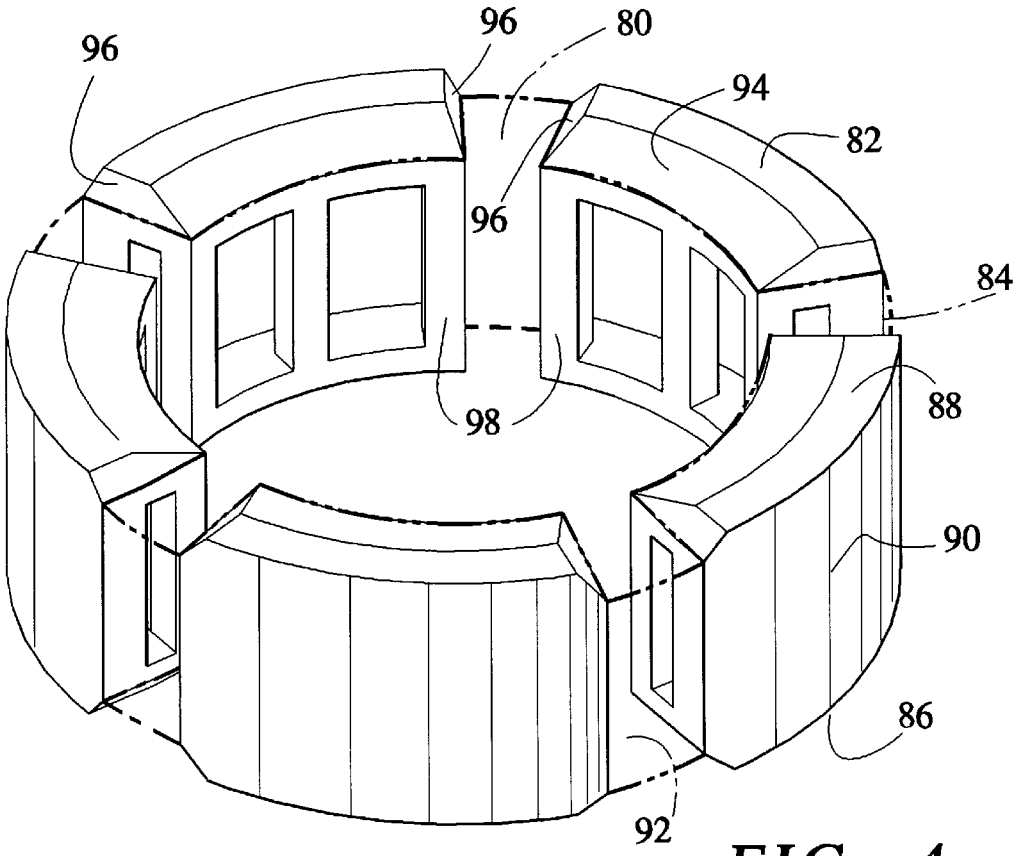
FIG. 4 is a perspective view, partially in phantom, of another embodiment of a puck including sliding members wrapped about the outer edges of the puck body.

Yet another embodiment of the invention is shown in FIGS. 4 and 5, wherein the puck body 80 (which is shown in phantom in FIG. 4) is molded with slider members 82 formed integrally therein. The puck body is cylindrical as in the above embodiments and may have a hollow interior with a liquid contained therein, or may be solid or hollow without liquid. The slider members 82 of the present embodiment extend about the cylindrical edges 84 of the puck 80. In particular, the slider members have a bottom edge 86 in contact with the playing surface when the puck 80 is positioned as shown in FIG. 4, a top edge 88 which is in contact with the playing surface when the puck 80 is inverted, and side surfaces 90 which contact the playing area boundary walls and the hockey sticks during play and which may be in contact with the playing surface should the puck 80 become tipped up on edge. The side surfaces 90 are curved to the same extent as the cylindrical wall 84 of the puck 80, and may be flush with the puck wall 84 or extend slightly beyond it. The spaces 92 between the slider members 82 are preferably small to reduce or eliminate the chance that the body of the puck 80 will contact the playing surface.

The top and bottom surfaces 88 and 86 of the slider members 82 include a bevel 94 angled toward the body of the puck 80 at the inside edges so that the outer edge of each slider member 82 is raised above the end faces of the puck 80. The edges 96 of the slider members 82 that are closest to one another are also beveled. This reduces the chance that a raised edge of the slider members 82 will catch a rough place on the playing surface or an edge of a hockey stick. The beveled edges provide particular advantage as the puck slides over the playing surface, especially a rough playing surface such as a parking lot or street.

To attach the slider members 82 to the puck 80, the slider members 82 include beams 98 extending through the puck 80. Three such beams 98 are provided for each of the slider members 82. The puck 80 is molded with the slider members 82 in place so that the material of the puck 80 extends about the beams 98 at locations 100. The sliders may have posts that are pushed in or otherwise fastened in place, instead. The slippery material of the slider members 82 is thereby in contact with a boundary wall or hockey stick regardless of the angle at which the puck is tipped.

An improvement of the sliding or slider members provides that bodies of the slider members are recessed into the surface of the puck to provide lateral support for the sliding members. The recess in the puck may be axial or may be angled inwardly somewhat toward the sliding member for a dove-tail fit for additional support and to prevent dislocation of the sliding member our of the puck.

Yet another embodiment of the present puck is shown in FIG. 6, wherein the puck 110 is shown in plan view having an outer ring 112 in which the slider members 114 are mounted. The outer ring 112 encircles a center portion 116 which includes means to absorb shock from impact. In the illustrated puck 110, the means to absorb shock is an arrangement of six curved spokes 118 extending from the outer ring 112 to a central core 120. The curved spokes 118 bend, permitting the outer ring 112 to flex to absorb impact shock. In this embodiment, the outer ring 112, the spokes 118 and the central core 120 are molded of a relatively soft yet durable elastomeric material. The material is flexible enough to permit the puck to be squeezed somewhat manually. In a preferred embodiment, the molded body is of a material having a durometer of 70 to 92.

Each of the spokes 118 of this embodiment are in the shape of a web which has its greatest dimensions extending axially and generally radially of the cylindrical puck 110. The central core 120 is a cylinder. The spokes 118 and the central core 120 have a height in the axial direction of the puck 110 slightly less than the dimension of the outer ring 112, so that the overall effect is a concave surface on the top and bottom of the puck 110. This ensures that the outer periphery, and the slider members 114 that are mounted there, are in contact with the playing surface even when the puck is used on a rough playing surface such as a street or parking lot.

The slider members 114 are provided about the periphery of the top and bottom surfaces of the cylindrical puck body, as can be seen in FIG. 7. The sliders 114 are, as in the preceding embodiments, formed of a material having a low coefficient of friction, at least lower than the coefficient of friction of the puck body and preferably much lower. The material of the sliders is ST nylon 801 in one embodiment and it is contemplated to use a silicon impregnated plastic in another embodiment. The slider members 114 are arcuate in shape in the plane of the puck surface and are arranged on the puck body to form a discontinuous ring as seen in FIG. 6. The portions 122 of the puck body 110 between the slider members 114 are to be kept as small as possible to prevent them from coming into contact with the playing surface. The sliders 114 are placed close enough to one another to prevent contact between the puck body and the playing surface at nearly any angle, yet, with the present brittle material of the sliders, enough space is provided therebetween to permit flexing of the puck without breakage of the sliders upon impact. In one embodiment, the slider members 114 extend about greater than 80 percent of the circumference of the puck 110.

As seen in the side view of FIG. 7, the sliders 114 project from both axial surfaces of the puck 110. The slider members 114 of the present embodiment have sides 124 that extend on the sides 126 of the puck 110 and are slightly beyond the outer edge of the outer ring 112 so that they are in contact with the playing surface even if the puck is tipped up on edge. In one prototype, the soft material of the puck body at a portion 128 between two opposed slider members 114 projects outward enough to be in contact with and receive the impact from surfaces that are substantially parallel to the axis if the puck 110. However, even variation of a few degrees from parallel causes the surface to contact one of the slider members 114 instead of the portion 128. This puck has been found to perform well, as the slider members 114 allow the puck 110 to slip back to the flat position on the playing surface yet the slight contact with the softer puck body at the portion 128 provides a softer, stickier surface for contact with the hockey stick. The shock absorbing properties of the flexible outer ring 112 and center portion 116 reduce bouncing by the puck 110.

In FIG. 8, one of the slider members 114 is shown in greater detail. Each slider 114 has two mounting posts 130 and 132, one post 130 of a smaller diameter which is solid and the other 132 of a larger diameter which is hollow. The solid post 130 fits in the hollow post 132 of another slider member 114 with a tight friction fit to hold the two together on opposite sides of the puck. The connection of two opposed sliders 114 is shown in FIG. 9.

The slider members 114 have beveled surfaces including an inside bevel 134, an outside bevel 136 and end bevels 138 and 140, which permit the slider member to move over rough surfaces.

A contemplated improvement is the addition of steel runners in the slider members 114 to reduce wear on the slider members. The steel runners would be imbedded in the sliders.

The present puck overcomes the lifting motion caused by the striking of the hockey stick due to the added slipperiness of the puck on the playing surface. The wider contact surfaces of the present slider members lessens the extent to which the sliders catch in small indentations in the playing surface so that the present puck glides over rough surfaces better than the previously known pucks. The puck has a reduced tendency to catch on rough parking lots and even on the seams of indoor courts. Since the slider members enable the puck to move over the surface without contact of the puck body on the playing surface, the puck body may be made of a material that is softer than previously possible and so better absorb shock.

Although other modifications and changes may be suggested by those skilled in the art, it is the intention of the inventors to embody within the patent warranted hereon all changes and modifications as reasonably and properly come within the scope of their contribution to the art.

We claim:

1. A hockey puck, comprising:

a cylindrical body of a diameter greater than an axial height and defining a hollow interior of a predetermined volume, a liquid in said interior space, said liquid filling less than said predetermined volume, wherein said cylindrical body is of a flexible plastic material, wherein said cylindrical body is of a wall thickness that is greater at a radial surface of said cylindrical body than at end walls of said cylindrical body.

2. A hockey puck, comprising;

a cylindrical body of a diameter greater than an axial height and defining a hollow interior of a predetermined volume, a liquid in said interior space, said liquid filling less than said predetermined volume, a baffle in said hollow interior space to divide said hollow interior space into parts, said baffle defining a passage through which at least some of said liquid flows when said cylindrical body is turned from a position with said axis in a first vertical direction to a position with said axis in a second vertical position.

3. A hockey puck, comprising:

a cylindrical body having end faces substantially transverse to an axis of the cylinder, said cylindrical body being of an axial height less than a diameter of said cylindrical body;

slider members attached to said cylindrical body at each of said end faces substantially adjacent a periphery of said end faces, said slider members being of a material having a lower coefficient of friction than a material of said cylindrical body, said slider members extending along a majority of said periphery of said end faces, said slider members each being arcuate in shape and having a radius with a center substantially identical to said axis of said cylindrical body.

4. A hockey puck as claimed in claim 3, wherein said slider members are arcuately-shaped and are positioned as segments of a circle at said periphery of said end faces.

5. A hockey puck as claimed in claim 3, wherein said cylindrical body defines a hollow interior space of a predetermined volume, and further comprising:

a liquid in said hollow interior space filling less than said predetermined space.

6. A hockey puck as claimed in claim 5, further comprising:

a baffle in said hollow interior space to divide said hollow interior space into parts, said baffle defining a passage through which at least some of said liquid flows when said cylindrical body is turned from a position with said axis in a first vertical direction to a position with said axis in a second vertical position.

7. A hockey puck as claimed in claim 3, wherein said slider members include posts extending into openings in said cylindrical body.

8. A hockey puck, comprising:

a cylindrical body having end faces substantially transverse to an axis of the cylinder, said cylindrical body being of an axial height less than a diameter of said cylindrical body;

slider members attached to said cylindrical body at each of said end faces substantially adjacent a periphery of said end faces, said slider members being of a material having a lower coefficient of friction than a material of said cylindrical body, said slider members extending along a majority of said periphery of said end faces, said slider members including posts extending into openings in said cylindrical body, said slider members each include at least two of said posts extending into said openings in said cylindrical body.

9. A hockey puck as claimed in claim 3, wherein six of said slider members are provided on each of said end faces of said cylindrical body.

10. A hockey puck as claimed in claim 3, wherein said slider members have beveled edges.

11. A hockey puck as claimed in claim 3, wherein said cylindrical body defines recesses into which said slider members fit so that said slider members extend above said end faces of said cylindrical body.

12. A hockey puck as claimed in claim 3, wherein said slider members extend from one end face to an other end face of said cylindrical body exposed along radial outer edges of said cylindrical body.

13. A hockey puck for street hockey or roller hockey, comprising:

a cylindrical body of a flexible material having a predetermined coefficient of friction, said cylindrical body being of a greater diameter than its axial height, said cylindrical body defining a hollow interior space, end faces of said cylindrical body being substantially transverse to an axis of said cylindrical body;

a baffle in said hollow interior space positioned to divide said hollow interior space into at least two chambers, said baffle defining an opening between said at least two chambers;

a liquid in said hollow interior space and filling less than all of said hollow interior space, said liquid flows through said opening in said baffle when an orientation of said cylindrical body is changed from a position with one of said at least two chambers lowermost to a position with another of said at least two chambers lowermost, slider members of a material having a lower coefficient of friction than said material of said cylindrical body, said slider members being attached to said cylindrical body at said end faces for supporting said cylindrical body on a surface.

14. A hockey puck as claimed in claim 13, wherein said slider members are arcuate shaped members attached to said cylindrical body at periphery of said end faces.

15. A hockey puck as claimed in claim 14, wherein six of said arcuate shaped members are on each of said end faces.

16. A hockey puck as claimed in claim 13, wherein said slider members have flat tops substantially transverse to an axis of said cylindrical body and beveled surfaces at edges of said slider members.

17. A hockey puck as claimed in claim 13, wherein said slider members each have at least two posts extending into openings in said cylindrical body for mounted said slider members thereon.

18. A hockey puck, comprising: a generally cylindrical body including:

an outer ring portion and a center portion within said outer ring portion, said center portion including means to absorb shock from said puck striking or being struck by a surface, said outer ring being of a relatively flexible material to flex under impact, slider members mounted in said outer ring, said slider members being of a material having a low coefficient of friction, said slider members extending above a plane of an axial end of said generally cylindrical body for contact with a generally planar playing surface to permit sliding of said puck on said slider members, said slider members having portions which are arcuate in shape in said plane of said axial end and extending collectively about a major portion of a circumference of said outer ring portion, said portions of said slider members which are arcuate in shape having a radius with a center substantially identical to an axis of cylindrical body.

19. A hockey puck as claimed in claim 18, wherein said center portion includes a core and a plurality of spokes extending from said core to said outer ring.

20. A hockey puck as claimed in claim 19, wherein said spokes are curved.

21. A hockey puck as claimed in claim 19, wherein said plurality of spokes is six spokes.

22. A hockey puck as claimed in claim 18, wherein said slider members extend over approximately 80 percent of an outer circumference of said outer cylinder.

23. A hockey puck as claimed in claim 18, wherein said slider members include six slider members.

24. A hockey puck, comprising:

a cylindrical body of a diameter greater than an axial height and defining a hollow interior of a predetermined volume, a liquid in said interior space, said liquid filling less than said predetermined volume, wherein said cylindrical body is of a flexible plastic material, wherein said cylindrical body is of a wall thickness that is greater at a radial surface of said cylindrical body than at end walls of said cylindrical body, and slider members mounted in said cylindrical body, said slider members being of a material having a low coefficient of friction, said slider members extending above a plane of an axial end of said generally cylindrical body for contact with a generally planar playing surface to permit sliding of said puck on said slider members.

25. A hockey puck, comprising:

a cylindrical body of a diameter greater than an axial height and defining a hollow interior of a predetermined volume, a liquid in said interior space, said liquid filling less than said predetermined volume, a baffle in said hollow interior space to divide said hollow interior space into parts, said baffle defining a passage through which at least some of said liquid flows when said cylindrical body is turned from a position with said axis in a first vertical direction to a position with said axis in a second vertical position, and slider members mounted in said cylindrical body, said slider members being of a material having a low coefficient of friction, said slider members extending above a plane of an axial end of said generally cylindrical body for contact with a generally planar playing surface to permit sliding of said puck on said slider members.

26. A hockey puck as claimed in claim 7, wherein said posts of said slider members on opposite sides of said puck connect to one another through said cylindrical body.

27. A hockey puck, comprising:

a cylindrical body having end faces substantially transverse to an axis of the cylinder and having a generally cylindrical surface, said cylindrical body being of an axial height less than a diameter of said cylindrical body;

slider members attached to said cylindrical body, said slider members being of a material having a lower coefficient of friction than a material of said cylindrical body, said slider members extending along a periphery of said end faces, said slider members extending over said generally cylindrical surface of said cylindrical body.

28. A hockey puck as claimed in claim 27, wherein said slider members are arcuate in shape in a plane of said end faces.

29. A hockey puck as claimed in claim 27, wherein said slider members include cylindrical surface portions extending over said generally cylindrical surface of said cylindrical body.

30. A hockey puck as claimed in claim 27, wherein said slider members each include a single part having an arcuate shaped surface in a plane of said end faces and a cylindrical surface portion extending over said generally cylindrical surface of said cylindrical body.

31. A hockey puck for play on a playing surface using hockey sticks, comprising:

a cylindrical body having end faces substantially transverse to an axis of the cylinder and having a radial surface, said cylindrical body being of an axial height less than a diameter of said cylindrical body;

slider means for sliding on the playing surface attached to said cylindrical body, said slider means being of a material having a lower coefficient of friction than a material of said cylindrical body, said slider means extending over a major portion of a periphery of said end faces and over a major portion of said radial surface for sliding contact with the playing surface in every orientation of hockey puck outside of a position with said axis parallel to said playing surface.

32. A hockey puck as claimed in claim 27, wherein said slider members extending along a periphery of said end faces are the same slider members as said slider members extending over said generally cylindrical surface of said cylindrical body.

33. A hockey puck, comprising:

a cylindrical body having end faces substantially transverse to an axis of the cylinder and having a generally cylindrical surface, said cylindrical body being of an axial height less than a diameter of said cylindrical body;

slider members attached to said cylindrical body, said slider members including slider surfaces of a material having a lower coefficient of friction than a material of said cylindrical body extending along a periphery of said end faces, said slider members including slider surfaces of a material having a lower coefficient of friction than a material of said cylindrical body extending over portions of said generally cylindrical surface of said cylindrical body, wherein said slider members including said slider surfaces extending along the periphery of said end faces are the same slider members as said slider members including said slider surfaces extending over portions of said generally cylindrical surface of said cylindrical body.

34. A hockey puck, comprising:

a cylindrical body having end faces substantially transverse to an axis of the cylinder and having a generally cylindrical surface, said cylindrical body being of an axial height less than a diameter of said cylindrical body;

slider members attached to said cylindrical body, said slider members including slider surfaces of a material having a lower coefficient of friction than a material of said cylindrical body extending along a periphery of said end faces said slider members including slider surfaces of a material having a lower coefficient of friction than a material of said cylindrical body extending over portions of said generally cylindrical surface of said cylindrical body, wherein said slider members prevent contact of said cylindrical body with a planar playing surface at all positions of said puck except at a puck position with an axis of said puck parallel to said playing surface.

35. A hockey puck, comprising:

a cylindrical body having end faces substantially transverse to an axis of the cylinder and having a generally cylindrical surface, said cylindrical body being of an axial height less than a diameter of said cylindrical body;

slider members attached to said cylindrical body, said slider members being of a material having a lower coefficient of friction than a material of said cylindrical body, said slider members including slider surfaces extending along a periphery of said end faces, said slider members including slider surfaces extending beyond said generally cylindrical surface of said cylindrical body for contact with a playing surface and to prevent contact with a planar playing surface at said generally cylindrical surface of said cylindrical body.

36. A hockey puck as claimed in claim 35, wherein said slider members are in recesses in said end faces.

37. A hockey puck, comprising:

a cylindrical body having end faces substantially transverse to an axis of the cylinder, said cylindrical body being of an axial height less than a diameter of said cylindrical body;

slider members attached to said cylindrical body, said slider members being of a material having a lower coefficient of friction than a material of said cylindrical body, said slider members extending from one end face to an other end face of said cylindrical body exposed along radial outer edges of said cylindrical body.

38. A hockey puck, comprising:

a cylindrical body having end faces substantially transverse to an axis of the cylinder, said cylindrical body being of an axial height less than a diameter of said cylindrical body;

slider members attached to said cylindrical body, said slider members being of a material having a lower coefficient of friction than a material of said cylindrical body, said slider members extending from said cylindrical body exposed along radial outer edges of said cylindrical body.

39. A hockey puck, comprising:

a cylindrical body having end faces substantially transverse to an axis of the cylinder, said cylindrical body being of an axial height less than a diameter of said cylindrical body;

means for preventing direct contact of said cylindrical body with a planar playing surface at all orientations of said cylindrical body except a position with said axis substantially parallel to said planar playing surface, said means for preventing including slider members attached to said cylindrical body, said slider members being of a material having a lower coefficient of Fiction than a material of said cylindrical body, said slider members extending along portions of said end faces, said slider members extending along portions of radial outer edges of said cylindrical body.

40. A hockey puck, comprising:

a cylindrical body having end faces substantially transverse to an axis of the cylinder, said cylindrical body being of an axial height less than a diameter of said cylindrical body;

means for preventing direct contact of said cylindrical body with a planar playing surface at all orientations of said cylindrical body relative to said planar playing surface, said means for preventing including slider members attached to said cylindrical body, said slider members being of a material having a lower coefficient of friction than a material of said cylindrical body, said slider members extending along portions of said end faces, said slider members extending along portions of radial outer edges of said cylindrical body.

* * * * *